United States Patent [19]

Osawa et al.

[11] Patent Number: 5,043,769

[45] Date of Patent: Aug. 27, 1991

[54] CLEANING DEVICE

[75] Inventors: Izumi Osawa; Shuji Iino, both of Osaka, Japan

[73] Assignee: Minolta Camera Kabushiki Kaisha, Osaka, Japan

[21] Appl. No.: 447,223

[22] Filed: Dec. 7, 1989

[30] Foreign Application Priority Data

Dec. 8, 1988 [JP] Japan ..... 63-310519

[51] Int. Cl.[5] ..... G03G 15/20

[52] U.S. Cl. ..... 355/299; 118/652

[58] Field of Search ..... 355/299, 296; 118/652

[56] References Cited

U.S. PATENT DOCUMENTS

| | | | |
|---|---|---|---|
| Re. 30,924 | 1/1975 | Katayama et al. | 15/256.51 |
| 4,026,648 | 5/1977 | Takahashi | 355/299 |
| 4,519,698 | 5/1985 | Kohyama et al. | 355/299 |
| 4,619,523 | 10/1986 | Maeda et al. | 355/299 |

FOREIGN PATENT DOCUMENTS

| | | | |
|---|---|---|---|
| 0122577 | 7/1983 | Japan | 355/299 |
| 0069679 | 4/1985 | Japan | 355/299 |
| 63-64074 | 3/1988 | Japan . | |

*Primary Examiner*—A. T. Grimley
*Assistant Examiner*—Robert Beatty
*Attorney, Agent, or Firm*—Willian Brinks Olds Hofer Gilson & Lione

[57] ABSTRACT

A cleaning device having a cleaning blade which has its forward end pressed into contact with the surface of an organic photosensitive member rotating at a peripheral speed of at least about 26 cm/sec to scrape off and remove residual developer from the surface of the photosensitive member. The contact face of the cleaning blade in contact with the photosensitive member makes a contact angle of about 9.5 to 14.5 degrees with a tangent line to the photosensitive member at the point of contact on one side of the blade toward the direction of rotation of the photosensitive member. The cleaning blade is pressed into contact with the photosensitive member with a force of about 0.1 to 10 g/mm. This prevents the cleaning blade from becoming reversed to entail improper cleaning or to impede the rotation of the photosensitive member.

11 Claims, 3 Drawing Sheets

CLEANING DEVICE

BACKGROUND OF THE INVENTION

The present invention relates to cleaning devices for use in electrophotographic apparatus or the like for removing the developer remaining on the surface of a photosensitive member after image transfer by scraping the developer off the surface, and more particularly to a cleaning device for removing the residual developer from the surface of an organic photosensitive member which is in rotation at a high peripheral speed of at least 26 cm/sec.

With conventional electrophotographic apparatus, the developer remaining on the surface of the photosensitive member after image transfer is removed generally by scraping off the developer from the surface of the photosensitive member with a cleaning blade held in pressing contact with the surface.

In addition to inorganic photosensitive members in which selenium, cadmium sulfide, amorphous silicon or the like is used, organic photosensitive members containing an organic photoconductive material have been introduced into wide use in recent years.

When the cleaning blade is used for removing the residual developer from the surface of the photosensitive member in high-speed systems wherein the member rotates at a high peripheral speed of at least 26 cm/sec, the cleaning blade often becomes raised off the surface of the photosensitive member owing to the vibration due to the high-speed rotation of the member, giving rise to the problem that the developer escapes through the clearance between the blade and the photosensitive member to produce image noises due to improper cleaning.

With the inorganic photosensitive member, improper cleaning can be remedied by pressing the cleaning blade against the member with an increased force or by using a cleaning blade made of a material of high restitution elasticity.

With the organic photosensitive member, however, the cleaning blade, when pressed on with a greater force, fails to slide on the photosensitive member smoothly and therefore becomes reversed to result in improper cleaning or impedes smooth rotation of the photosensitive member to necessitate an increased torque Furthermore, the organic photosensitive member, which is lower than the inorganic photosensitive member in hardness, has the problem that the increased force applied to the cleaning blade causes the blade to abrade the member to result in uneligible wear and markedly shortens the life of the member.

The surface wear of the organic photosensitive member can be diminished by forming a protective layer over the surface as is practiced in recent years, but the frictional contact of the cleaning blade with the member still remains unremedied Thus, the blade is likely to become reversed to entail improper cleaning or impede the rotation of the member.

Accordingly, in the case of electrophotographic apparatus wherein the photosensitive member is made of an organic material and rotated at a high peripheral speed of at least 26 cm/sec, there is a need to use a different cleaning device such as one having a fur brush for removing the residual developer from the surface of the member Another problem is then encountered in that the device is complex in construction and costly.

SUMMARY OF THE INVENTION

An object of the present invention is to overcome the foregoing problems and to provide a cleaning device for removing residual developer from the surface of an organic photosensitive member which is rotated at a high peripheral speed of at least 26 cm/sec for use in an electrophotographic apparatus or the like.

Another object of the present invention is to provide a cleaning device for removing residual developer from the surface of an organic photosensitive member rotating at a high peripheral speed of at least 26 cm/sec, with use of an inexpensive cleaning blade of simple construction and yet without the likelihood of leaving some developer unremoved and free of troubles such as abrasion or a malfunction of the photosensitive member and improper cleaning due to the reversal of the cleaning blade.

To fulfill the above objects, the present invention provides a cleaning device which comprises a cleaning blade having its forward end pressed into contact with the surface of an organic photosensitive member rotating at a peripheral speed of at least 26 cm/sec to scrape off and remove residual developer from the surface of the photosensitive member, the contact face of the cleaning blade in contact with the photosensitive member making a contact angle of 9.5 to 14.5 degrees with the tangent line to the photosensitive member at the point of contact on one side thereof toward the direction of rotation of the photosensitive member, the cleaning blade being pressed into contact with the photosensitive member with a force of 0.1 to 10 g/mm.

BRIEF DESCRIPTION OF THE DRAWINGS

The foregoing and other objects or features of the present invention will become apparent from the following description of preferred embodiments thereof taken in conjunction with the accompanying drawings, in which.

In the following description, like parts are designated by like reference numbers throughout the several drawings

DETAILED DESCRIPTION OF THE INVENTION

The contact angle of the cleaning blade is set to 9.5 to 14.5 degrees because at contact angles of less than 9.5 degrees, the residual developer on the surface of the photosensitive member remains partly unremoved when a small force of pressing contact is applied which the member withstands, and further because at contact angles greater than 14.5 degrees, a greater torque is required for rotating the photosensitive member even if the force applied is acceptable, to result in a malfunction and increased wear of the member and improper cleaning due to the reversal of the blade.

The cleaning blade is pressed into contact with the photosensitive member with a force of 0.1 to 10 g/mm because if the force is less than 0.1 g/mm, the blade will not be pressed against the member effectively even when the contact angle is in the specified range, permitting some developer to remain unremoved from the surface of the member If the force is greater than 10 g/mm, an increased torque is required for rotating the photosensitive member even when the blade contact angle is in the specified range, consequently entailing a malfunction and increased wear of the member.

Figure 1:
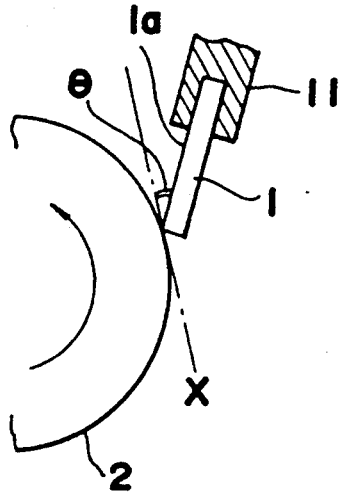
FIGS. 1(A) to (D) are fragmentary diagrams showing different cleaning blades each in contact with a photosensitive member for use in the present invention.
Figure 1:
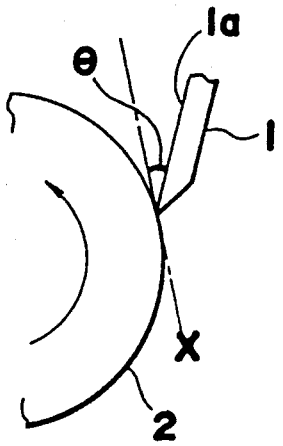
Figure 1:
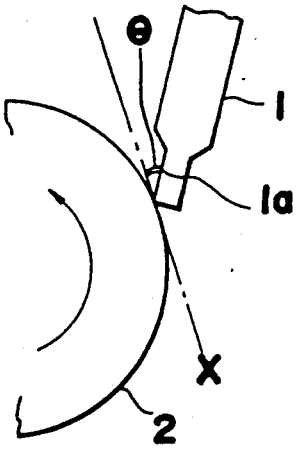
Figure 1:
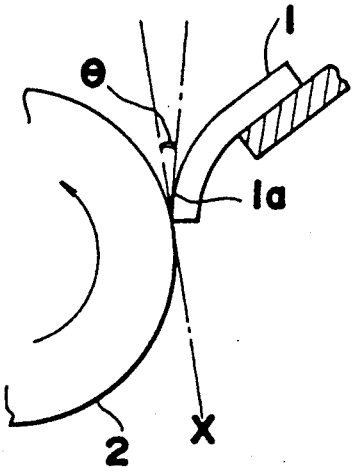

According to the present invention, the cleaning blade to be held in pressing contact with the organic photosensitive member as stated above is usually in the form of a planar plate of uniform thickness as indicated at 1 in FIG. 1 (A). The cleaning blade 1 is supported by a blade holder 11 and has its forward end pressed against the surface of the organic photosensitive member 2 in rotation.

The cleaning blade 1 is so positioned that the contact face la of the blade 1 in contact with the photosensitive member 2 makes a contact angle of 9.5 to 14.5 degrees with the tangent line x to the member 2 at the point of contact on one side thereof toward the direction of rotation of the member 2, whereby even when the cleaning blade 1 is pressed into contact with the member 2 with a relatively small force which the organic photosensitive member 2 withstands and which is variable over a very wide range of 0.1 to 10 g/mm, the blade is operable properly without leaving any developer unremoved or without causing a malfunction or wear of the member 2.

The cleaning blade 1 to be used is not limited to the one shown in FIG. 1 (A), but various blades are usable. FIG. 1 (B) shows a cleaning blade 1 which is chamfered at one corner of its forward end opposite to the other corner thereof in contact with the member 2, the blade end thus having an acute angle. FIG. 1 (C) shows a cleaning blade 1 which is not uniform in thickness but has a thin end in contact with the member 2. FIG. 1 (D) shows a cleaning blade 1 having a bent end in contact with the surface of the member 2.

When to be used, these cleaning blades 1 are so positioned that a contact angle of 9.5 to 14.5 degrees is formed between the contact face la of the blade in contact with the photosensitive member 2 and the tangent line x to the member 2 at the point of contact on one side thereof toward the direction of rotation of the member 2. It is then possible to hold the blade 1 in pressing contact with the photosensitive member with a relatively small force in the very wide range of 0.1 to 10 g/mm.

Figure 2:
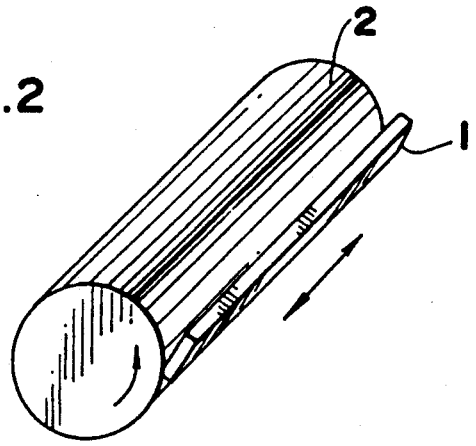
FIG. 2 is a schematic perspective view showing the cleaning blade as made movable to and fro axially of the photosensitive member for use in the cleaning device of the invention.

In order to scrape off the residual developer from the surface of the organic photosensitive member 2 in rotation efficiently, it is desirable to move the cleaning blade 1 to and fro axially of the photosensitive member 2 as shown in FIG. 2.

If the cleaning blade 1 is held in pressing contact with a definite portion of the member 2 for a prolonged period of time, the contact portion will appear as an image noise, as a so-called contact memory, when half images are copied, depending on the type of member 2 used. Accordingly, it is desirable to hold the cleaning blade 1 out of contact with the surface of the member 2 while the member 2 is not in rotation.

DESCRIPTION OF THE PREFERRED EMBODIMENTS

Embodiments of the invention will be described in detail with reference to the accompanying drawings.

Figure 3:
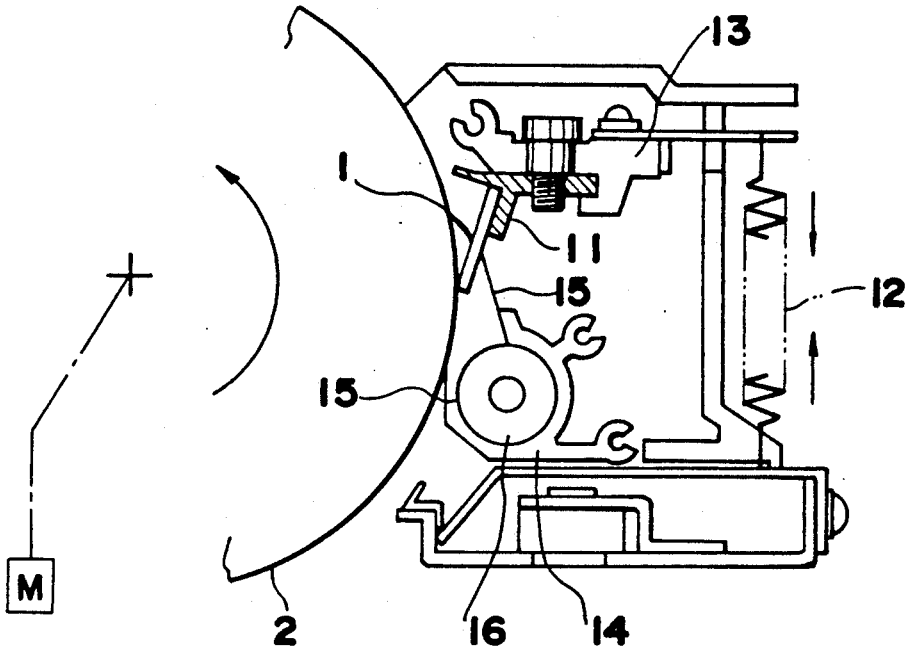
FIG. 3 is a schematic view in section of an embodiment of cleaning device of the invention.

FIG. 3 shows a cleaning blade 1 in the form of a planar plate for use in the embodiment to be described. The cleaning blade 1 is supported by a blade holder 11 and has its forward end pressed into contact with the surface of an organic photosensitive member 2 rotating at a high peripheral speed of 26 cm/sec by the motor M.

For this purpose, the holder 11 supporting the cleaning blade 1 is attached to a pressing member 13 provided with a pressure adjusting spring 12 at its one end to cause the spring 12 to bias the forward end of the blade 1 into pressing contact with the surface of the member 2 in rotation.

The angle of the cleaning blade 1 with respect to the photosensitive member 2 is adjusted by suitably shaping the holder 11 supporting the blade 1. More specifically, the contact face la of the cleaning blade 1 in contact with the member 2 makes a contact angle $\theta$ of 9.5 to 14.5 degrees with the tangent line x to the member 2 at the point of contact on one side thereof toward the direction of rotation of the member 2. The contact force to be exerted by the cleaning blade 1 is adjusted by the pressure adjusting spring 12, such that the blade 1 is pressed into contact with the photosensitive member 2 with a force of 0.1 to 10 g/mm.

In this way, the cleaning blade 1 is pressed against the surface of the photosensitive member 2 rotating at a high peripheral speed of at least 26 cm/mm for the blade 1 to scrape off the developer remaining on the surface of the member 2. The developer thus scraped off is guided to developer transporting means 16 inside a holding member 14 by means of guide members 15 attached to the holding member 14. The developer is then transported by the developer transporting means 16 and collected in a bottle (not shown).

Figure 4:
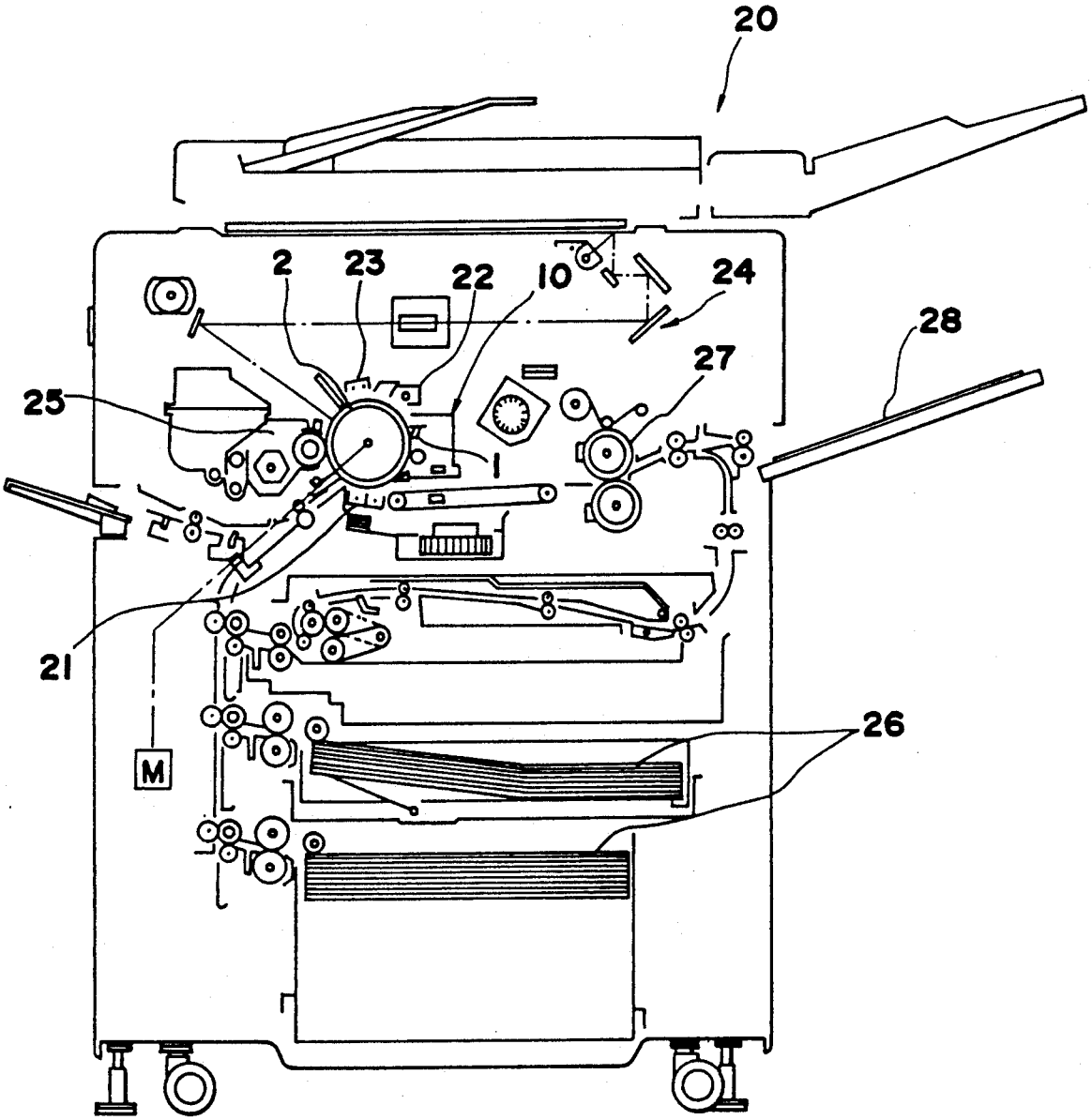
FIG. 4 is a schematic view in section of an electrophotographic apparatus having the cleaning device of FIG. 3 incorporated therein.

The cleaning device 10 thus constructed is installed in an electrophotographic apparatus 20 for use as will be described in detail below with reference to FIG. 4.

The electrophotographic apparatus 20 is a commercial copying machine (Model EP870, product of MINOLTA CAMERA KABUSHIKI KAISHA) which is so modified that the organic photosensitive member 2 used is selectively chargeable positively or negatively in accordance with the charge polarity of the member 2. The cleaning device 10 is disposed between a transferseparating charger 21 and an eraser lamp 22.

The organic photosensitive member 2 installed in the electrophotographic apparatus 20 is rotated at a high peripheral speed of at least 26 cm/sec, and the surface of the member 2 is sensitized by a charger 23 and then exposed to light by an optical system 24 according to image data to form an electrostatic latent image on the surface of the member 2. A developer is supplied to the surface from a developing unit 25 to convert the latent image to a toner image.

The toner image thus formed on the surface of the photosensitive member 2 is transferred onto recording paper 26 by the transfer-separating charger 21 and then fixed to the paper 26 by a fixing roller 27 The paper is thereafter delivered onto a paper tray 28.

On the other hand, after the toner image has been transferred from the photosensitive member 2 to the recording paper 26 as stated above, the cleaning blade 1 of the cleaning device 10 is pressed into contact with the surface of the member 2 in rotation to scrape off and remove the developer remaining on the surface The surface of the member 2 is thereafter illuminated with the eraser lamp 22 for the removal of charge.

Using several kinds of cleaning blades 1 and different kinds of organic photosensitive members 2, electrophotographic apparatus 20 like the one described above were operated while varying the contact angle $\theta$ of the cleaning blade 1 with respect to the photosensitive member 2, the contact force of the cleaning blade 1 on the member 2 and the peripheral speed of the member 2 to evaluate the cleaning performance of the blade 1 in removing the residual developer from the surface of the photosensitive member 2, the rotational driving characteristics of the member 2 and the abrasion characteristics of the member 2.

Cleaning Blades Used

Cleaning blades A1 to A4 prepared from the following four kinds of urethane rubbers were used.

The urethane rubbers used for making the cleaning blades 1 were a product of HOKUSHIN INDUSTRIES, INC., brand No. 231780 for the first cleaning blade Al, a product of the same company, brand No. 233730 for the second cleaning blade A2, a product of the same company, brand No. 238670 for the third cleaning blade A3, and a product of TOKAI RUBBER INDUSTRIES, LI.D., brand No. T65A for the fourth cleaning blade A4. Each of these cleaning blades Al to A4 was supported by the holder 11 as seen in FIG. 1.

Table 1 below shows the thickness, Young's modulus, tensile strength and restitution elasticity of the cleaning blades Al to A4.

TABLE 1

| Blade | Thickness (mm) | Young's modulus (kg/cm$^2$) | Tensile strength (kg/cm$^2$) | Restitution elasticity (%) |
|---|---|---|---|---|
| A1 | 3 | 108 | 400 | 35 |
| A2 | 3 | 39 | 350 | 25 |
| A3 | 3 | 28 | 320 | 68 |
| A4 | 2 | 19 | 260 | 20 |

Organic Photosensitive Members

The following six kinds of organic photosensitive members B1 to B6 were used.

Organic Photosensitive Member B1

To prepare the organic photosensitive member B1, a titanyl phthalocyanine (TiOPc) film was formed as a charge generating layer over a hollow cylindrical aluminum substrate, 120 mm in diameter and 330 mm in length. Resorting to resistance heating, the titanyl phthalocyanine film was formed by vacuum evaporation to a thickness of 2500 angstroms at a boat temperature of 400 to 500° C. in a vacuum of $10^{-4}$ to $10-6$ torr.

The charge generating layer was then coated with a solution of 1 part by weight of p-bisdiethylaminotetraphenylbutadiene and 1 part by weight of polycarbonate resin (K-1300, product of TEIJIN CHEMICALS, LTD.) in 6 parts by weight of THF to a thickness of 15 micrometers when dried. The coating was dried to form a charge transport layer.

Figure 5:
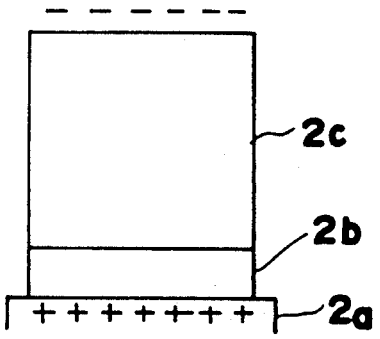
FIGS. 5 (A), (B) and (C) are schematic views of photosensitive members used in test examples.
Figure 5:
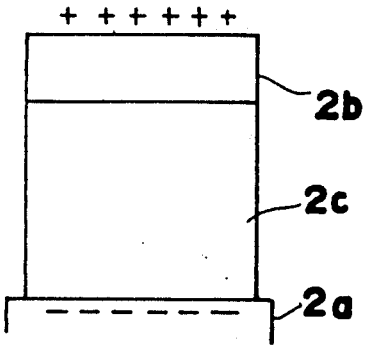
Figure 5:
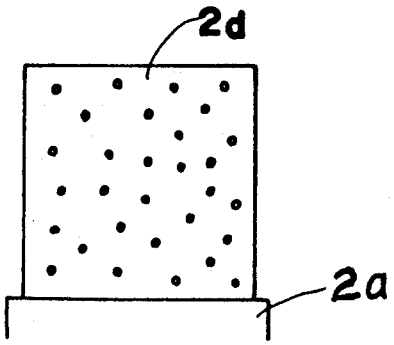

With the organic photosensitive member B1 thus prepared, the charge generating layer **2*b* and the charge transport layer 2*c* are superposed on the aluminum substrate 2*a* as seen in FIG. 5 (A). For use in the electrophotographic apparatus 20, the member B1** is negatively charged.

Organic Photosensitive Member B2

To prepare the organic photosensitive member B2, a hollow cylindrical aluminum substrate, 120 mm in diameter and 330 mm in length, was coated with a solution of 1 part by weight of the styryl compound of the structural formula (I) given below and 1 part by weight of polycarbonate resin (K-1300, product of TEIJIN CHEMICALS, LTD.) in 10 parts by weight of dichloromethane to a thickness of 15 micrometers when dried. The coating was dried to form a charge transport layer

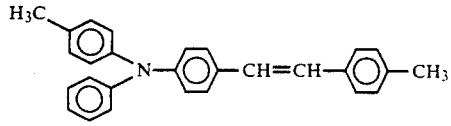

(I)

The charge transport layer was then coated with a dispersion prepared from 5 parts by weight of the anthanthrone compound of the structural formula (II) given below, 1 part by weight of the styryl compound of the formula (I) and polycarbonate resin (K-1300, product of TEIJIN CHEMICALS, LTD.) by treating these compounds in a ball mill for 24 hours. The coating was formed by dipping and dried to obtain a charge generating layer, 5 micrometers in thickness.

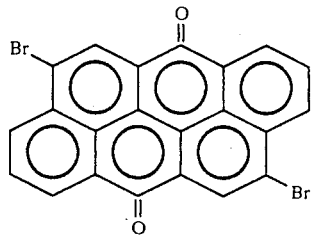

(II)

With the organic photosensitive member B2 thus prepared, the charge transport layer **2*c* and the charge generating layer 2*b* are superposed on the aluminum substrate 2*a* as seen in FIG. 5 (B). For use in the electrophotographic apparatus 20, the member B2** is positively charged.

Organic Photosensitive Member B3

To prepare the organic photosensitive member B3, a mixture of 25 parts by weight of special alpha-type copper phthalocyanine (product of TOYO INK MFG. CO., LTD.), 50 parts by weight of acrylmelamine thermosetting resin (mixture of A-405 and SUPER BECKAMINE J820, product of DAINIPPON INK & CHEMICALS, INC.), 25 parts by weight of 4-diethylaminobenzaldehyde-diphenylhydrazone and 500 parts by weight of organic solvent (mixture of 7 parts by weight of xylene and 3 parts by weight of butanol) was pulverized in a ball mill for 10 hours to obtain a dispersion.

A hollow cylindrical aluminum substrate, 120 mm in diameter and 330 mm in length, was coated with the dispersion by spraying. The coating was dried and baked at 150° C. for 1 hour to form a photosensitive layer, 15 micrometers in thickness.

The organic photosensitive member B3 thus prepared had the photosensitive layer the 2*d* over the aluminum substrate 2*a* as seen in FIG. 5 (C). For use in the electrophotographic apparatus 20, the member B3 is positively charged.

Organic Photosensitive Members B4–B6

These organic photosensitive members B4, B5 and B6 were prepared by forming a plasma organic polymerization film respectively over the organic photosensitive members B1, B2 and B3 prepared as above, by a plasma organic polymerization reaction The film served as a surface protective layer of high hardness.

The plasma organic polymerization film was formed by known CVD under the conditions: hydrogen gas flow rate of 300 sccm, butadiene gas flow rate of 15 sccm, reaction pressure of 0.3 torr, discharge frequency of 80 KHz, discharge power of 150 W, substrate temperature of 70° C. and film forming time of 4 minutes. Thus, the surface protective layer, 0.1 micrometer in thickness, was formed on each of the organic photosensitive members B1, B2 and B3.

For use in the electrophotographic apparatus 20, these organic photosensitive members B4, B5 and B6 are charged to the same polarity as the respective original photosensitive members B1, B2 and B3.

The contact angle $\theta$ of the cleaning blade 1 with respect to the photosensitive member was altered by selectively using one of different holders 11 for supporting the blade 1 as seen in FIG. 3. The contact force of the cleaning blade on the photosensitive member was altered by changing the pressure adjusting spring 12 for pressing the blade 1 into contact with the surface of the photosensitive member 2.

The developer for use in the developing unit 25 of the electrophotographic apparatus 20 was a developer comprising two components, i.e., a toner and a carrier.

The toner to be used was selected according to the polarity to which the organic photosensitive member 2 installed in the apparatus 20 was charged. Thus, a positively chargeable toner was used when the member 2 was used as negatively charged, or a negatively chargeable toner was used when the member was used as positively charged.

The positively chargeable toner was prepared by thoroughly mixing together in a ball mill 100 parts by weight of styrene-n-butylmethacrylate resin (softening point 132° C., glass transition point 60° C.), 5 parts by weight of carbon black (MA #8, product of MITSUBISHI CHEMICAL INDUSTRIES, LTD.), 3 parts by weight of Nigrosine dye (Bontron N-01, product of ORIENT CHEMICAL INDUSTRIES, LTD.) and 2 parts by weight of low molecular weight polypropylene (Viscol 550P, product of SANYO CHEMICAL INDUSTRIES, LTD.), kneading the mixture with three rolls heated to 140° C., allowing the mixture to stand for cooling, roughly grinding the mixture by a whizzer mill, further pulverizing the ground mixture by a jet mill, and classifying the product with air to obtain a fraction, 13 micrometers in mean particle size, as the positively chargeable toner.

The negatively chargeable toner was prepared by thoroughly mixing together in a ball mill 100 parts by weight of polyester resin (softening point 130° C., glass transition point 60° C.), 5 parts by weight of carbon black (MA #8, product of MITSUBISHI CHEMICAL INDUSTRIES, LTD.), 3 parts by weight of chromium complex dye (Spiron Black TRH, product of HODOGAYA CHEMICAL CO., LTD.) and 2 parts by weight of oxidized low molecular weight polypropylene (Viscol TS-200, product of SANYO CHEMICAL INDUSTRIES, LTD.), kneading the mixture with three rolls heated to 140° C., allowing the mixture to stand for cooling, roughly grinding the mixture by a whizzer mill, further pulverizing the ground mixture by a jet mill, and classifying the product with air to obtain a negatively chargeable toner.

Before use, each of the toners was subjected to an aftertreatment with colloidal silica (brand name: R-974, product of NIPPON AEROSIL CO., LTD.) in an amount of 0.01 part by weight per 100 parts by weight of the toner.

On the other hand, the carrier was prepared by thoroughly mixing together in a Henschel mixer 100 parts by weight of polyester resin (softening point 123° C, glass transition point 65° C., AV 23, OHV 40), 500 parts by weight of Fe-Zn ferrite fine particles (MRP-2, product of TDK ELECTRONICS CO., LTD.) and 2 parts by weight of carbon black (MA #8, product of MITSUBISHI CHEMICAL INDUSTRIES, LTD.), pulverizing the mixture, melting and kneading the mixture by an extruder-kneader with its cylinder portion set to 180° C. and its cylinder head portion to 170° C., cooling the resulting mixture, roughly grinding the mixture with a whizzer mill, further pulverizing the mixture in a jet mill and classifying the particles with a classifier to obtain a fraction, 60 micrometers in mean particle size, as the carrier.

Next, the following methods were used for evaluating the cleaning performance of the blade in removing the residual developer from the surface of the photosensitive member, the rotational driving characteristics of the member and the abrasion characteristics of the member.

Evaluation of Cleaning Performance

For the evaluation of the cleaning performance, the surface of the organic photosensitive member 2 as installed in the electrophotographic apparatus 20 was charged to 650 V and exposed to light with use of a 6% chart to form an electrostatic latent image. The developer was then supplied to the surface of the member 2 from the developing unit 25 to form a toner image.

Subsequently, the cleaning blade 1 was pressed into contact with the surface of the organic photosensitive member 2, with the toner image formed thereon without transferring the toner image to recording paper, to remove the developer from the surface of the member 2.

The surface of the photosensitive member thus cleaned of the developer was checked. In the case where the developer was found remaining partially unremoved when observed with the eye to produce an image noise on the copy image, the result is indicated by X. In the case where no developer was found remaining when observed with the eye, and no problem would arise for use although the developer slightly adhered to white flannel if the surface of the member was wiped therewith, the result is indicated by Δ. When no developer was found even if the surface was wiped with white flannel, this satisfactory result is represented by ○.

Evaluation of Driving Characteristics of Photosensitive Member

For the evaluation of the driving characteristics of the photosensitive member, the torque (cm/kg) of the photosensitive member 2 was measured using a torque gauge (TP-10KCE, product of KYOWA ELECTRONIC INDUSTRIES CO., LTD.) mounted on the drive shaft of the member 2 installed in the electrophotographic apparatus 20 and also using Amplifier WGA-700A (brand name), product of the same company.

When the contact force of the cleaning blade on the photosensitive member was excessively great such that the member was not rotatable, the result is indicated by When the torque of the photosensitive member exceeded 10 cm/kg, necessitating a drive motor of higher torque although no problem would arise for use, the result is represented by Δ. When the torque of the member was up to 10 cm/kg, this satisfactory result is represented by ○.

Evaluation of Abrasion Characteristics of Photosensitive Member

For the evaluation of the abrasion characteristics of the photosensitive member as in the case of the evaluation of the cleaning performance, the surface of the organic photosensitive member 2 as installed in the apparatus 20 was charged to 650 V, exposed to light with use of a 6% chart to form an electrostatic latent image, and supplied with the developer from the developing unit 25 to form a toner image. Without transferring the toner image from the surface of the member 2 to recording paper but with the toner image formed on the surface, the cleaning blade 1 was pressed into contact with the surface of the member 2 to remove the developer applied to the surface.

After repeating this cleaning operation 10,000 times, the surface of the organic photosensitive member was checked for the amount of resulting abrasion. If the amount is less than 1 micrometer, the result was evaluated as satisfactory and is represented by ○. If the amount of abrasion was 1 to 8 micrometers, presenting no problem in use despite a reduction in the copy density, the result is indicated by Δ. When the amount of abrasion was over 8 micrometers, entailing impaired chargeability, a reduced copy density and a problem in use, the result is expressed by X.

Next, more specific test examples will be described wherein the electrophotographic apparatus 20 was used.

Test Examples 1–48

Tests were conducted to evaluate the cleaning performance, the driving characteristics of the photosensitive member and the abrasion characteristics of the member, using the four kinds of cleaning blades A1 to A4 and the six kinds of photosensitive members B1 to B6, setting the cleaning blade at a contact angle in the range of 9.5 to 14.5 degrees according to the invention, setting the peripheral speed of the photosensitive member to the range of 26.0 to 60.0 cm/sec, and varying the contact force of the cleaning blade over the range of 0.04 to 15 g/mm.

Table 2 below shows the kinds of cleaning blades used, the kinds of photosensitive members, varying angles $\theta$ of the blade and varying speeds of the photosensitive member in Test Examples 1 to 48.

TABLE 2

| Test Example | Blade | Photosensitive member | Contact angle (deg) | Peripheral speed (cm/sec) |
|---|---|---|---|---|
| 1 | A4 | B4 | 9.5 | 26.0 |
| 2 | A3 | B5 | 9.5 | 40.0 |
| 3 | A1 | B6 | 9.5 | 60.0 |
| 4 | A4 | B4 | 10.0 | 26.0 |
| 5 | A2 | B5 | 10.0 | 60.0 |
| 6 | A1 | B4 | 11.0 | 26.0 |
| 7 | A2 | B4 | 11.0 | 40.0 |
| 8 | A3 | B4 | 11.0 | 26.0 |
| 9 | A4 | B4 | 11.0 | 60.0 |
| 10 | A4 | B4 | 12.0 | 26.0 |
| 11 | A3 | B5 | 12.0 | 26.0 |
| 12 | A2 | B6 | 12.0 | 26.0 |
| 13 | A4 | B4 | 13.0 | 26.0 |
| 14 | A4 | B4 | 13.0 | 40.0 |
| 15 | A4 | B4 | 13.0 | 60.0 |
| 16 | A4 | B5 | 13.0 | 60.0 |
| 17 | A4 | B6 | 13.0 | 40.0 |
| 18 | A4 | B6 | 13.0 | 60.0 |
| 19 | A4 | B4 | 14.0 | 26.0 |
| 20 | A1 | B5 | 14.0 | 40.0 |
| 21 | A1 | B6 | 14.0 | 60.0 |
| 22 | A4 | B4 | 14.5 | 26.0 |
| 23 | A2 | B5 | 14.5 | 60.0 |
| 24 | A3 | B6 | 14.5 | 40.0 |
| 25 | A4 | B1 | 9.5 | 26.0 |
| 26 | A3 | B2 | 9.5 | 40.0 |
| 27 | A1 | B3 | 9.5 | 60.0 |
| 28 | A4 | B1 | 10.0 | 26.0 |
| 29 | A3 | B2 | 10.0 | 60.0 |
| 30 | A1 | B1 | 11.0 | 26.0 |
| 31 | A2 | B1 | 11.0 | 40.0 |
| 32 | A3 | B1 | 11.0 | 26.0 |
| 33 | A4 | B1 | 11.0 | 60.0 |
| 34 | A4 | B1 | 12.0 | 26.0 |
| 35 | A3 | B2 | 12.0 | 26.0 |
| 36 | A2 | B3 | 12.0 | 26.0 |
| 37 | A4 | B1 | 13.0 | 26.0 |
| 38 | A4 | B1 | 13.0 | 40.0 |
| 39 | A4 | B1 | 13.0 | 60.0 |
| 40 | A4 | B2 | 13.0 | 60.0 |
| 41 | A4 | B3 | 13.0 | 40.0 |
| 42 | A4 | B3 | 13.0 | 60.0 |
| 43 | A4 | B1 | 14.0 | 26.0 |
| 44 | A1 | B2 | 14.0 | 40.0 |
| 45 | A1 | B3 | 14.0 | 60.0 |
| 46 | A4 | B1 | 14.5 | 26.0 |
| 47 | A2 | B2 | 14.5 | 60.0 |
| 48 | A3 | B3 | 14.5 | 40.0 |

In Test Examples 1 to 48, the cleaning performance, and the driving characteristics and abrasion characteristics of the photosensitive member were evaluated, varying the contact force of the cleaning blade over the range of 0.04 to 15 g/mm as stated above.

The results are shown in Table 3 below, in which "C" stands for the cleaning performance, "D" for the driving characteristics of the photosensitive member, and "A" for the abrasion characteristics of the member.

TABLE 3

| Test | Contact force of blade (g/mm) | | | | | | | | | | | | | | | | | | | | |
|---|---|---|---|---|---|---|---|---|---|---|---|---|---|---|---|---|---|---|---|---|---|
| | 0.04 | | | 0.1 | | | 0.28 | | | 0.85 | | | 1.4 | | | 2.0 | | | 2.5 | | |
| Ex. | C | D | A | C | D | A | C | D | A | C | D | A | C | D | A | C | D | A | C | D | A |
| 1 | X | ○ | ○ | Δ | ○ | ○ | Δ | ○ | ○ | Δ | ○ | ○ | Δ | ○ | ○ | Δ | ○ | ○ | Δ | ○ | ○ |
| 2 | X | ○ | ○ | Δ | ○ | ○ | Δ | ○ | ○ | Δ | ○ | ○ | Δ | ○ | ○ | Δ | ○ | ○ | Δ | ○ | ○ |
| 3 | X | ○ | ○ | Δ | ○ | ○ | Δ | ○ | ○ | Δ | ○ | ○ | Δ | ○ | ○ | Δ | ○ | ○ | Δ | ○ | ○ |

TABLE 3-continued

| | | | | | | | | | | | | | | | | | | | |
|---|---|---|---|---|---|---|---|---|---|---|---|---|---|---|---|---|---|---|---|
| 4 | X | ○ | ○ | Δ | ○ | ○ | Δ | ○ | ○ | Δ | ○ | ○ | Δ | ○ | ○ | Δ | ○ | ○ | ○ |
| 5 | X | ○ | ○ | Δ | ○ | ○ | Δ | ○ | ○ | Δ | ○ | ○ | Δ | ○ | ○ | Δ | ○ | ○ | ○ |
| 6 | X | ○ | ○ | Δ | ○ | ○ | ○ | ○ | ○ | ○ | ○ | ○ | ○ | ○ | ○ | ○ | ○ | ○ | ○ |
| 7 | X | ○ | ○ | Δ | ○ | ○ | ○ | ○ | ○ | ○ | ○ | ○ | ○ | ○ | ○ | ○ | ○ | ○ | ○ |
| 8 | X | ○ | ○ | Δ | ○ | ○ | ○ | ○ | ○ | ○ | ○ | ○ | ○ | ○ | ○ | ○ | ○ | ○ | ○ |
| 9 | X | ○ | ○ | Δ | ○ | ○ | ○ | ○ | ○ | ○ | ○ | ○ | ○ | ○ | ○ | ○ | ○ | ○ | ○ |
| 10 | X | ○ | ○ | Δ | ○ | ○ | ○ | ○ | ○ | ○ | ○ | ○ | ○ | ○ | ○ | ○ | ○ | ○ | ○ |
| 11 | X | ○ | ○ | Δ | ○ | ○ | ○ | ○ | ○ | ○ | ○ | ○ | ○ | ○ | ○ | ○ | ○ | ○ | ○ |
| 12 | X | ○ | ○ | Δ | ○ | ○ | ○ | ○ | ○ | ○ | ○ | ○ | ○ | ○ | ○ | ○ | ○ | ○ | ○ |
| 13 | X | ○ | ○ | Δ | ○ | ○ | ○ | ○ | ○ | ○ | ○ | ○ | ○ | ○ | ○ | ○ | ○ | ○ | ○ |
| 14 | X | ○ | ○ | Δ | ○ | ○ | ○ | ○ | ○ | ○ | ○ | ○ | ○ | ○ | ○ | ○ | ○ | ○ | ○ |
| 15 | X | ○ | ○ | Δ | ○ | ○ | ○ | ○ | ○ | ○ | ○ | ○ | ○ | ○ | ○ | ○ | ○ | ○ | ○ |
| 16 | X | ○ | ○ | Δ | ○ | ○ | ○ | ○ | ○ | ○ | ○ | ○ | ○ | ○ | ○ | ○ | ○ | ○ | ○ |
| 17 | X | ○ | ○ | Δ | ○ | ○ | ○ | ○ | ○ | ○ | ○ | ○ | ○ | ○ | ○ | ○ | ○ | ○ | ○ |
| 18 | X | ○ | ○ | Δ | ○ | ○ | ○ | ○ | ○ | ○ | ○ | ○ | ○ | ○ | ○ | ○ | ○ | ○ | ○ |
| 19 | X | ○ | ○ | Δ | ○ | ○ | ○ | ○ | ○ | ○ | ○ | ○ | ○ | ○ | ○ | ○ | ○ | ○ | ○ |
| 20 | X | ○ | ○ | Δ | ○ | ○ | ○ | ○ | ○ | ○ | ○ | ○ | ○ | ○ | ○ | ○ | ○ | ○ | ○ |
| 21 | X | ○ | ○ | Δ | ○ | ○ | ○ | ○ | ○ | ○ | ○ | ○ | ○ | ○ | ○ | ○ | ○ | ○ | ○ |
| 22 | X | ○ | ○ | Δ | ○ | ○ | ○ | ○ | ○ | ○ | ○ | ○ | Δ | ○ | ○ | Δ | ○ | ○ | Δ |
| 23 | X | ○ | ○ | Δ | ○ | ○ | ○ | ○ | ○ | ○ | ○ | ○ | Δ | ○ | ○ | Δ | ○ | ○ | Δ |
| 24 | X | ○ | ○ | Δ | ○ | ○ | ○ | ○ | ○ | ○ | ○ | ○ | Δ | ○ | ○ | Δ | ○ | ○ | Δ |
| 25 | X | ○ | ○ | Δ | ○ | ○ | Δ | ○ | ○ | ○ | ○ | ○ | ○ | ○ | ○ | ○ | ○ | ○ | ○ |
| 26 | X | ○ | ○ | Δ | ○ | ○ | Δ | ○ | ○ | Δ | ○ | ○ | ○ | ○ | ○ | ○ | ○ | ○ | ○ |
| 27 | X | ○ | ○ | Δ | ○ | ○ | Δ | ○ | ○ | ○ | ○ | ○ | ○ | ○ | ○ | ○ | ○ | ○ | ○ |
| 28 | X | ○ | ○ | Δ | ○ | ○ | Δ | ○ | ○ | ○ | ○ | ○ | ○ | ○ | ○ | ○ | ○ | ○ | ○ |
| 29 | X | ○ | ○ | Δ | ○ | ○ | Δ | ○ | ○ | ○ | ○ | ○ | ○ | ○ | ○ | ○ | ○ | ○ | ○ |
| 30 | X | ○ | ○ | Δ | ○ | ○ | ○ | ○ | ○ | ○ | ○ | ○ | ○ | ○ | ○ | ○ | ○ | ○ | ○ |
| 31 | X | ○ | ○ | Δ | ○ | ○ | ○ | ○ | ○ | ○ | ○ | ○ | ○ | ○ | ○ | ○ | ○ | ○ | ○ |
| 32 | X | ○ | ○ | Δ | ○ | ○ | ○ | ○ | ○ | ○ | ○ | ○ | ○ | ○ | ○ | ○ | ○ | ○ | ○ |
| 33 | X | ○ | ○ | Δ | ○ | ○ | ○ | ○ | ○ | ○ | ○ | ○ | ○ | ○ | ○ | ○ | ○ | ○ | ○ |
| 34 | X | ○ | ○ | Δ | ○ | ○ | ○ | ○ | ○ | ○ | ○ | ○ | ○ | ○ | ○ | ○ | ○ | ○ | ○ |
| 35 | X | ○ | ○ | Δ | ○ | ○ | ○ | ○ | ○ | ○ | ○ | ○ | ○ | ○ | ○ | ○ | ○ | ○ | ○ |
| 36 | X | ○ | ○ | Δ | ○ | ○ | ○ | ○ | ○ | ○ | ○ | ○ | ○ | ○ | ○ | ○ | ○ | ○ | ○ |
| 37 | X | ○ | ○ | Δ | ○ | ○ | ○ | ○ | ○ | ○ | ○ | ○ | ○ | ○ | ○ | ○ | ○ | ○ | ○ |
| 38 | X | ○ | ○ | Δ | ○ | ○ | ○ | ○ | ○ | ○ | ○ | ○ | ○ | ○ | ○ | ○ | ○ | ○ | ○ |
| 39 | X | ○ | ○ | Δ | ○ | ○ | ○ | ○ | ○ | ○ | ○ | ○ | ○ | ○ | ○ | ○ | ○ | ○ | ○ |
| 40 | X | ○ | ○ | Δ | ○ | ○ | ○ | ○ | ○ | ○ | ○ | ○ | ○ | ○ | ○ | ○ | ○ | ○ | ○ |
| 41 | X | ○ | ○ | Δ | ○ | ○ | ○ | ○ | ○ | ○ | ○ | ○ | ○ | ○ | ○ | ○ | ○ | ○ | ○ |
| 42 | X | ○ | ○ | Δ | ○ | ○ | ○ | ○ | ○ | ○ | ○ | ○ | ○ | ○ | ○ | ○ | ○ | ○ | ○ |
| 43 | X | ○ | ○ | Δ | ○ | ○ | ○ | ○ | ○ | ○ | ○ | ○ | ○ | ○ | ○ | ○ | ○ | ○ | Δ |
| 44 | X | ○ | ○ | Δ | ○ | ○ | ○ | ○ | ○ | ○ | ○ | ○ | ○ | ○ | ○ | ○ | ○ | ○ | Δ |
| 45 | X | ○ | ○ | Δ | ○ | ○ | ○ | ○ | ○ | ○ | ○ | ○ | ○ | ○ | ○ | ○ | ○ | ○ | Δ |
| 46 | X | ○ | ○ | Δ | ○ | ○ | ○ | ○ | ○ | ○ | ○ | ○ | ○ | ○ | ○ | Δ | ○ | ○ | Δ |
| 47 | X | ○ | ○ | Δ | ○ | ○ | ○ | ○ | ○ | ○ | ○ | ○ | ○ | ○ | ○ | Δ | ○ | ○ | Δ |
| 48 | X | ○ | ○ | Δ | ○ | ○ | ○ | ○ | ○ | ○ | ○ | ○ | ○ | ○ | ○ | Δ | ○ | ○ | Δ |

| | Contact force of blade (g/mm) | | | | | | | | | | | | | | |
|---|---|---|---|---|---|---|---|---|---|---|---|---|---|---|---|
| Test | 3.4 | | | 4.5 | | | 6.6 | | | 10 | | | 15 | | |
| Ex. | C | D | A | C | D | A | C | D | A | C | D | A | C | D | A |
| 1 | Δ | ○ | ○ | ○ | ○ | ○ | ○ | Δ | ○ | Δ | Δ | Δ | X | ○ | ○ |
| 2 | Δ | ○ | ○ | ○ | ○ | ○ | ○ | Δ | ○ | Δ | Δ | Δ | X | ○ | ○ |
| 3 | Δ | ○ | ○ | ○ | ○ | ○ | ○ | Δ | ○ | Δ | Δ | Δ | X | ○ | ○ |
| 4 | ○ | ○ | ○ | ○ | ○ | ○ | ○ | Δ | ○ | ○ | Δ | Δ | X | ○ | ○ |
| 5 | ○ | ○ | ○ | ○ | ○ | ○ | ○ | Δ | ○ | ○ | Δ | Δ | X | ○ | ○ |
| 6 | ○ | ○ | ○ | ○ | ○ | ○ | ○ | Δ | ○ | ○ | Δ | Δ | X | ○ | ○ |
| 7 | ○ | ○ | ○ | ○ | ○ | ○ | ○ | Δ | ○ | ○ | Δ | Δ | X | ○ | ○ |
| 8 | ○ | ○ | ○ | ○ | ○ | ○ | ○ | Δ | ○ | ○ | Δ | Δ | X | ○ | ○ |
| 9 | ○ | ○ | ○ | ○ | ○ | ○ | ○ | Δ | ○ | ○ | Δ | Δ | X | ○ | ○ |
| 10 | ○ | ○ | ○ | ○ | ○ | ○ | ○ | Δ | ○ | ○ | Δ | Δ | — | X | — |
| 11 | ○ | ○ | ○ | ○ | ○ | ○ | ○ | Δ | ○ | ○ | Δ | Δ | — | X | — |
| 12 | ○ | ○ | ○ | ○ | ○ | ○ | ○ | Δ | ○ | ○ | Δ | Δ | — | X | — |
| 13 | ○ | ○ | ○ | ○ | ○ | ○ | ○ | Δ | ○ | ○ | Δ | Δ | — | X | — |
| 14 | ○ | ○ | ○ | ○ | ○ | ○ | ○ | Δ | ○ | ○ | Δ | Δ | — | X | — |
| 15 | ○ | ○ | ○ | ○ | ○ | ○ | ○ | Δ | ○ | ○ | Δ | Δ | — | X | — |
| 16 | ○ | ○ | ○ | ○ | ○ | ○ | ○ | Δ | ○ | ○ | Δ | Δ | — | X | — |
| 17 | ○ | ○ | ○ | ○ | ○ | ○ | ○ | Δ | ○ | ○ | Δ | Δ | — | X | — |
| 18 | ○ | ○ | ○ | ○ | ○ | ○ | ○ | Δ | ○ | ○ | Δ | Δ | — | X | — |
| 19 | ○ | ○ | ○ | ○ | Δ | ○ | ○ | Δ | ○ | ○ | Δ | Δ | — | X | — |
| 20 | ○ | ○ | ○ | ○ | Δ | ○ | ○ | Δ | ○ | ○ | Δ | Δ | — | X | — |
| 21 | ○ | ○ | ○ | ○ | Δ | ○ | ○ | Δ | ○ | ○ | Δ | Δ | — | X | — |
| 22 | ○ | Δ | ○ | ○ | Δ | ○ | ○ | Δ | Δ | ○ | Δ | Δ | — | X | — |
| 23 | ○ | Δ | ○ | ○ | Δ | ○ | ○ | Δ | Δ | ○ | Δ | Δ | — | X | — |
| 24 | ○ | Δ | ○ | ○ | Δ | ○ | ○ | Δ | Δ | ○ | Δ | Δ | — | X | — |
| 25 | ○ | ○ | ○ | ○ | ○ | ○ | ○ | ○ | Δ | Δ | ○ | Δ | X | ○ | Δ |
| 26 | ○ | ○ | ○ | ○ | ○ | ○ | ○ | ○ | Δ | Δ | ○ | Δ | X | ○ | Δ |
| 27 | ○ | ○ | ○ | ○ | ○ | ○ | ○ | ○ | Δ | Δ | ○ | Δ | X | ○ | Δ |
| 28 | ○ | ○ | ○ | ○ | ○ | ○ | ○ | ○ | Δ | ○ | ○ | Δ | X | ○ | Δ |
| 29 | ○ | ○ | ○ | ○ | ○ | ○ | ○ | ○ | Δ | ○ | ○ | Δ | X | ○ | Δ |
| 30 | ○ | ○ | ○ | ○ | ○ | ○ | ○ | ○ | Δ | ○ | ○ | Δ | X | ○ | Δ |
| 31 | ○ | ○ | ○ | ○ | ○ | ○ | ○ | ○ | Δ | ○ | ○ | Δ | X | ○ | Δ |
| 32 | ○ | ○ | ○ | ○ | ○ | ○ | ○ | ○ | Δ | ○ | ○ | Δ | X | ○ | Δ |
| 33 | ○ | ○ | ○ | ○ | ○ | ○ | ○ | ○ | Δ | ○ | ○ | Δ | X | ○ | Δ |

TABLE 3-continued

| | | | | | | | | | | | | | | |
|---|---|---|---|---|---|---|---|---|---|---|---|---|---|---|
| 34 | ○ | ○ | ○ | ○ | ○ | ○ | ○ | ○ | Δ | ○ | ○ | Δ | Δ | Δ | X |
| 35 | ○ | ○ | ○ | ○ | ○ | ○ | ○ | ○ | Δ | ○ | ○ | Δ | Δ | Δ | X |
| 36 | ○ | ○ | ○ | ○ | ○ | ○ | ○ | ○ | Δ | ○ | ○ | Δ | Δ | Δ | X |
| 37 | ○ | ○ | ○ | ○ | ○ | Δ | ○ | ○ | Δ | ○ | Δ | Δ | Δ | Δ | X |
| 38 | ○ | ○ | ○ | ○ | ○ | Δ | ○ | Δ | Δ | ○ | Δ | Δ | Δ | Δ | X |
| 39 | ○ | ○ | ○ | ○ | ○ | Δ | ○ | Δ | Δ | ○ | Δ | Δ | Δ | Δ | X |
| 40 | ○ | ○ | ○ | ○ | ○ | Δ | ○ | Δ | Δ | ○ | Δ | Δ | Δ | Δ | X |
| 41 | ○ | ○ | ○ | ○ | ○ | Δ | ○ | ○ | Δ | ○ | Δ | Δ | Δ | Δ | X |
| 42 | ○ | ○ | ○ | ○ | ○ | Δ | ○ | Δ | Δ | ○ | Δ | Δ | Δ | Δ | X |
| 43 | ○ | ○ | Δ | ○ | ○ | Δ | ○ | Δ | Δ | ○ | Δ | Δ | Δ | Δ | X |
| 44 | ○ | ○ | Δ | ○ | ○ | Δ | ○ | Δ | Δ | ○ | Δ | Δ | — | X | — |
| 45 | ○ | ○ | Δ | ○ | ○ | Δ | ○ | Δ | Δ | ○ | Δ | Δ | — | X | — |
| 46 | ○ | ○ | Δ | ○ | Δ | Δ | ○ | Δ | Δ | ○ | Δ | Δ | — | X | — |
| 47 | ○ | Δ | Δ | ○ | Δ | Δ | ○ | Δ | Δ | ○ | Δ | Δ | — | X | — |
| 48 | ○ | ○ | Δ | ○ | Δ | Δ | ○ | Δ | Δ | ○ | Δ | Δ | — | X | — |

The results given above indicate that when the contact force of the cleaning blade was less than 0.1 g/mm, the developer was found partly unremoved from the surface of the photosensitive member when observed with the eye, presenting some problem in use.

When the contact force of the cleaning blade was in excess of 10 g/mm, a great torque was required for driving the photosensitive member, resulting in improper rotation of the member, marked abrasion of the member and improper cleaning due to the contact of the blade except at its end, hence problems in use.

In contrast, when the contact force of the blade was set to the range of the invention, i.e., 0.1 to 10 g/mm, satisfactory results were achieved in respect of the cleaning performance, the driving characteristics of the photosensitive member and the abrasion characteristics thereof, or the cleaning device was found usable free of problems.

Test Examples 49–56

In these test examples, the cleaning blade was set at a contact angle 8 of less than 9.5 degrees outside the range specified by the invention.

Table 4 below shows the kinds of cleaning blades, the kinds of photosensitive members, varying contact angles $\theta$ of the cleaning blade and varying peripheral speeds of the photosensitive member used in Test Examples 49 to 56.

TABLE 4

| Test Example | Blade | Photosensitive member | Contact angle (deg) | Peripheral speed (cm/sec) |
|---|---|---|---|---|
| 49 | A4 | B4 | 8.5 | 26.0 |
| 50 | A4 | B4 | 9.0 | 26.0 |
| 51 | A3 | B5 | 9.0 | 26.0 |
| 52 | A4 | B6 | 9.0 | 40.0 |
| 53 | A4 | B1 | 8.5 | 26.0 |
| 54 | A4 | B1 | 9.0 | 26.0 |
| 55 | A3 | B2 | 9.0 | 26.0 |
| 56 | A4 | B3 | 9.0 | 40.0 |

In Test Examples 49 to 56, the cleaning performance, and the driving characteristics and abrasion characteristics of the photosensitive member were evaluated, varying the contact force of the cleaning blade over the range of 0.1 to 0.85 g/mm within the specified range of the invention.

The results are shown in Table 5 below, in which "C" stands for the cleaning performance, "D" for the driving characteristics of the photosensitive member, and "A" for the abrasion characteristics of the member.

TABLE 5

| Test | Contact force of blade (g/mm) | | | | | | | | |
|---|---|---|---|---|---|---|---|---|---|
| | 0.1 | | | 0.28 | | | 0.85 | | |
| Ex. | C | D | A | C | D | A | C | D | A |
| 49 | X | ○ | ○ | X | ○ | ○ | X | ○ | ○ |
| 50 | X | ○ | ○ | X | ○ | ○ | X | ○ | ○ |
| 51 | X | ○ | ○ | X | ○ | ○ | X | ○ | ○ |
| 52 | X | ○ | ○ | X | ○ | ○ | X | ○ | ○ |
| 53 | X | ○ | ○ | X | ○ | ○ | X | ○ | ○ |
| 54 | X | ○ | ○ | X | ○ | ○ | Δ | ○ | ○ |
| 55 | X | ○ | ○ | X | ○ | ○ | X | ○ | ○ |
| 56 | X | ○ | ○ | X | ○ | ○ | Δ | ○ | ○ |

These results indicate that when the contact angle of the cleaning blade was set to less than 9.5 degrees outside the range of the invention, the developer remained unremoved from the surface of the photosensitive member markedly, giving rise to the problem of noises on the copy image and presenting difficulties in use.

Test Examples 57–68

In these test examples, the cleaning blade was set to a contact angle $\theta$ of at least 15 degrees outside the range specified by the invention.

Table 6 below shows the kinds of cleaning blades, the kinds of photosensitive members, varying contact angles $\theta$ of the cleaning blade and varying peripheral speeds of the photosensitive member used in Test Examples 57 to 68.

TABLE 6

| Test Example | Blade | Photosensitive member | Contact angle (deg) | Peripheral speed (cm/sec) |
|---|---|---|---|---|
| 57 | A3 | B6 | 15.0 | 40.0 |
| 58 | A2 | B5 | 15.0 | 60.0 |
| 59 | A4 | B6 | 15.0 | 40.0 |
| 60 | A4 | B4 | 15.0 | 26.0 |
| 61 | A4 | B4 | 15.5 | 26.0 |
| 62 | A4 | B4 | 18.0 | 26.0 |
| 63 | A3 | B3 | 15.0 | 40.0 |
| 64 | A2 | B2 | 15.0 | 60.0 |
| 65 | A4 | B3 | 15.0 | 40.0 |
| 66 | A4 | B1 | 15.0 | 26.0 |
| 67 | A4 | B1 | 15.5 | 26.0 |
| 68 | A4 | B1 | 18.0 | 26.0 |

In Test Examples 57 to 68, the cleaning performance, and the driving characteristics and abrasion characteristics of the photosensitive member were evaluated, varying the contact force of the cleaning blade.

Consequently, Examples 57 to 68 revealed that when the contact force of the cleaning blade was set to 3.4 g/mm or greater, it was almost impossible to drive the photosensitive member, presenting difficulties in the operation of the apparatus, while the photosensitive member was abraded markedly.

Incidentally, even when the cleaning blade was set to a contact angle outside the range of 9.5 to 14.5 degrees according to the invention as in Test Examples 49 to 68, there were cases wherein the cleaning blade was made operable free of problems in respect of the cleaning performance, the driving characteristics of the photosensitive member and the abrasion characteristics thereof by giving the cleaning blade a suitable contact force which was not always limited to the range of the invention. In these cases, however, the range of settable contact forces was very narrow.

Accordingly, it was difficult to adjust the contact force of the cleaning blade. Furthermore, depending on the type of developer used, filming, fusion of black spots or like trouble will occur unless the magnitude of the blade contact force is suitably altered, whereas the range of settable contact forces is then so narrow that the blade contact force is not variable for use. Extreme difficulties encountered in actual use entails a greatly increased cost when to be overcome in one way or another.

As described in detail above, the cleaning device of the present invention comprises a cleaning blade having its forward end pressed into contact with the surface of an organic photosensitive member rotating at a peripheral speed of at least 26 cm/sec to scrape off and remove the developer remaining on the surface of the member. The contact face of the cleaning blade in contact with the photosensitive member makes a contact angle of 9.5 to 14.5 degrees with the tangent line to the photosensitive member at the point of contact on one side thereof toward the direction of rotation of the member, and the blade is pressed into contact with the photosensitive member with a force of 0.1 to 10 g/cm. Accordingly, the developer remaining on the surface of the photosensitive member is thoroughly removable, while the member is rotatable with a reduced torque and with a reduced likelihood of malfunctioning and wear. The invention obviates the likelihood that the photosensitive member will not be cleaned properly by precluding the cleaning blade from becoming reversed or from coming into contact with the member at a portion of the blade other than its forward end.

Although the present invention has been fully described by way of examples with reference to the accompanying drawings, it is to be noted that various changes and modifications will be apparent to those skilled in the art. Therefore, unless otherwise such changes and modifications depart from the scope of the invention, they should be construed as being included therein.

What is claimed is:

1. In a copying apparatus which includes a cleaning device for removing residual toner from a surface of an organic photosensitive member including a photosensitive layer which comprises binder resin as a main component, the apparatus comprising:

means for rotating said organic photosensitive member at a peripheral speed of more than 26 cm/sec;

a cleaning blade so disposed to have its one end in pressing contact with the surface of said rotating organic photosensitive member to define a contact angle of 9.5 to 14.5 degrees with a tangent line to he rotating direction of the photosensitive member; and means for pressing said cleaning blade to the photosensitive member with a force of 0.1 to 10 g/mm.

2. A copying apparatus as claimed in claim 1, wherein said cleaning blade defines said contact angle at a downstream side of said contacting end of the cleaning blade with respect to the rotating direction of the photosensitive member.

3. A copying apparatus as claimed in claim 2, wherein said cleaning blade extends from said contacting end to the downstream side of said contacting end with respect to the rotating direction of the organic photosensitive member, so that said residual toner is scratched off in the direction opposite to that of the movement of said photosensitive member.

4. A copying apparatus as claimed in claim 1, wherein said cleaning blade has a toner removing part and a blade holding part, said removing part contacting the surface of the photosensitive member and said holding part being connected to the means for pressing the cleaning blade to press said removing part to the photosensitive member.

5. A copying apparatus as claimed in claim 4, wherein said removing part is composed of an elastic member.

6. A copying apparatus as claimed in claim 4, wherein said means for pressing the cleaning blade includes a spring which is connected to said holding part.

7. A copying apparatus as claimed in claim 1, wherein said organic photosensitive member comprises a photosensitive layer including an organic photosensitive material and an amorphous overcoat layer prepared by plasma polymerization.

8. A cleaning device for a copying apparatus including an organic photosensitive member for supporting an electrostatic latent image thereon, said organic photosensitive member including a photosensitive layer which comprises binder resin as a main component, a developing device which develops said latent image with a toner to form a toner image and a transfer device which transfers said toner image to a copy sheet, comprising:

driving means for rotating the photosensitive member at a peripheral speed of more than 26 cm/sec;

a cleaning blade for scraping off a residual toner from said rotating photosensitive member after transfer of said toner image to the copy sheet, said blade so deposed to have its one edge in pressing contact with the surface of said rotating photosensitive member;

supporting means for supporting said cleaning blade to define a contact angle of 9.5 to 14.5 degrees with a tangent line to the rotting direction of the photosensitive member at a downstream side of the contacting edge of said blade with respect to the rotating direction of the photosensitive member so as to scrape off said residual toner in the opposite direction of the rotating direction of the photosensitive member; and urging means for urging said supporting means so that si cleaning blade pressures the surface of the photosensitive member with a force of 0.1 to 10 g/mm.

9. A cleaning device for a copying apparatus including an organic photosensitive member including a photosensitive layer which comprises binder resin as a main component comprising:

means for rotating the photosensitive member at a peripheral speed of more than 26 cm/sec;

a cleaning blade being so disposed to have its one end in pressing contact with the surface of said photosensitive member as said photosensitive member rotates at a peripheral speed of more than 26 cm/sec, said blade scraping off a residual toner from the photosensitive member;

means for maintaining said cleaning blade to form an acute angle of 9.5 to 14.5 degrees with a tangent line to the rotating direction of the photosensitive member so as to scrape off said residual toner in the opposite direction of the rotating direction of the photosensitive member; and means for exerting pressure against said blade to attain a pressing force of 0.1 to 10 g/mm on the surface of the organic photosensitive member.

10. A cleaning device for an electrophotographic copying apparatus wherein an electrostatic latent image formed on a surface of an organic photosensitive member including a photosensitive layer which comprises binder resin as a main component is developed with a toner to form a toner image and said toner image is transferred to a copying sheet comprising:

means for rotating the photosensitive member at a peripheral speed of more than 26 cm/sec;

a cleaning blade to remove a residual toner from the photosensitive member in a direction opposite to the rotating direction of the photosensitive member;

means for maintaining said cleaning blade so as to have the ned of said cleaning blade form an acute angle of 9.5 to 14.5 degrees with a tangent line to the rotating direction of the photosensitive member; and means for exerting pressure against said blade to attain a pressing force of 0.1 to 10 g/mm on the surface of the organic photosensitive member when said means for maintaining said cleaning blade forms said acute angle.

11. In an image forming apparatus which includes a cleaning means for removing a residual toner from a surface of an organic photosensitive member including a photosensitive layer which comprises binder resin as a main component, the apparatus comprising:

means for rotating said organic photosensitive member at a peripheral speed of more than 26 cm/sec:

said cleaning means including a blade so deposed with its one end portion in pressing contact with the surface of said organic photosensitive member, said blade being so deposed to confront, with the organic photosensitive member with respect to the rotating direction and forming an acute angle of 9.5 to 14. 5degrees with respect to the tangent line of the rotating organic photosensitive member; and means for exerting pressure against said blade to attain a pressing force of 0.1 to 10 g/mm on the surface of the organic photosensitive member.

* * * * *

UNITED STATES PATENT AND TRADEMARK OFFICE

CERTIFICATE OF CORRECTION

PATENT NO. : 5,043,769

DATED : August 27, 1991

INVENTOR(S) : Izumi Osawa, et al.

It is certified that error appears in the above-identified patent and that said Letters Patent is hereby corrected as shown below:

In col. 1, line 47, after "torque", insert --.-- (period).

In col. 1, line 52, change "uneligible" to --unnegligible--.

In col. 1, line 58, after "unremedied", insert --.-- (period).

In col. 1, line 67, after "member", insert --.-- (period).

In col. 3, line 9, after "member", insert --.-- (period).

In col. 4, line 50, change "transferseparating" to --transfer-separating--.

In col. 4, line 63, after "27", insert --.-- (period).

In col. 5, line 28, change "L I.D." to --LTD.--.

In col. 6, line 13, after "layer", insert --.-- (period).

UNITED STATES PATENT AND TRADEMARK OFFICE

CERTIFICATE OF CORRECTION

PATENT NO. : 5,043,769

DATED : August 27, 1991

INVENTOR(S) : Izumi Osawa, et al.

It is certified that error appears in the above-identified patent and that said Letters Patent is hereby corrected as shown below:

In col. 7, line 12, after "reaction", insert --.-- (period).

In col. 8, line 9, after "a", insert --fraction, 13 micrometers, in mean particle size, as the--.

In col. 9, line 14, after "by", insert --X.--.

In col. 13, line 39, change "8" to -- ⊖--.

In col. 15, line 66 (claim 1, line 11), change "he" to --the--.

In col. 16, line 47 (claim 8, line 15), change "deposed" to --disposed--.

In col. 16, line 52 (claim 8, line 20), change "rotting" to --rotating--.

In col. 16, line 60 (claim 8, line 28), change "si" to --said--.

In col. 16, line 60 (claim 8, line 28), change "pressures" to --presses--.

UNITED STATES PATENT AND TRADEMARK OFFICE

CERTIFICATE OF CORRECTION

PATENT NO. : 5,043,769 Page 3 of 3

DATED : August 27, 1991

INVENTOR(S) : Izumi Osawa, et al.

It is certified that error appears in the above-identified patent and that said Letters Patent is hereby corrected as shown below:

In col. 18, line 2 (claim 10, line 15), change "ned" to --end--.

In col. 18, line 18 (claim 11, line 8), change "deposed" to --disposed--.

In col. 18, line 21 (claim 11, line 11), change "deposed" to --disposed--.

In col. 18, line 24 (claim 11, line 14), change "14. 5degrees" to --14.5 degrees--.

Signed and Sealed this

Ninth Day of March, 1993

*Attest:*

STEPHEN G. KUNIN

*Attesting Officer*

*Acting Commissioner of Patents and Trademarks*